United States Patent [19]

Tomlin

[11] 4,124,946

[45] Nov. 14, 1978

[54] BUILT-IN INSOLE AND ARTICLE OF FOOTWEAR CONTAINING SAME

[75] Inventor: Benjamin B. A. Tomlin, Walgrave, England

[73] Assignee: Scholl, Inc., Chicago, Ill.

[21] Appl. No.: 784,518

[22] Filed: Apr. 4, 1977

[30] Foreign Application Priority Data

Apr. 2, 1976 [GB] United Kingdom ..... 14115/76

[51] Int. Cl.[2] ..... A43B 13/38; A43B 3/12; A43B 13/12

[52] U.S. Cl. ..... 36/43; 36/11.5; 36/30 R

[58] Field of Search ..... 36/43, 44, 11.5, 14, 36/30 R

[56] References Cited

U.S. PATENT DOCUMENTS

| | | | |
|---|---|---|---|
| 2,725,645 | 12/1955 | Scala | 36/30 R X |
| 2,786,237 | 3/1957 | Keen et al. | 36/14 X |
| 3,175,308 | 3/1965 | Werman et al. | 36/14 |
| 3,766,669 | 10/1973 | Pearsall | 36/43 |
| 3,968,577 | 7/1976 | Jackson | 36/43 |

FOREIGN PATENT DOCUMENTS

| | | | |
|---|---|---|---|
| 2,279,348 | 2/1976 | France | 36/11.5 |

*Primary Examiner*—Patrick D. Lawson
*Attorney, Agent, or Firm*—Hill, Gross, Simpson, Van Santen, Steadman, Chiara & Simpson

[57] ABSTRACT

This invention relates to a supporting insole built into a shoe or other article of footwear, and to the article of footwear containing said insole, the insole being shaped to conform to the plantar surface of a human foot and seated in a recess in the outsole to which the insole and upper are attached.

8 Claims, 8 Drawing Figures

BUILT-IN INSOLE AND ARTICLE OF FOOTWEAR CONTAINING SAME

BRIEF SUMMARY OF THE INVENTION

This invention relates to a built-in insole and article of footwear containing the same. During the manufacture of a shoe or the like the insole is firmly secured both to an outer sole and the upper whereby the insole cannot become maladjusted. The insole is preferably made of a moldable, non-rigid material so that it may readily flex with the outer sole when walking, running, standing on the toes, etc. on its upper surface the insole is contoured in keeping with the plantar surface of a human foot and in a manner to support the foot in an anatomically correct position while lending a cushioning effect on the sole of the foot as well as being absorbent to perspiration, if so desired. The contouring of the upper surface of the insole includes a cupped heel seat having an upwardly extending rim therearound which merges into an elevation beneath the inner longitudinal arch of the foot; at the forward part there is a depression for the metatarsal-phalangeal articulation of the first metatarsal head and posterior extremity of the great toe. In front of the metatarsal-phalangeal junctions of the foot is a curvate elevation which underlies the four smaller toes but terminates short of the large toe, and anterior of that elevation, which varies in width and heighth, is a depression for the tip of the great toe and a depression for the tip of the smaller of fifth toe which may aid in take-off when starting a new step.

The outer sole is provided in its top face with a recess into which the lower portion of the insole intimately fits and the lower portion of the insole may be cemented to the outer sole within the recess. The shoe upper may have its edges turned under the insole within the recess and those edges are tapered so that firm securement may be had, or the upper may be stitched to a flange on the insole and to the outer sole as well, if desired. The insole is not for purposes of exercising the foot, since when the foot is confined in a shoe beneficial exercise is not effected. It is intended that the insole provides an anatomically correct rest for a foot, gives the foot a good feeling, and provides a beneficial support to the foot should it happen to become necessary but which is unfelt by a normal foot, and is less tiring to the user even though the shoe may be worn in a standing position all day.

The most pertinent prior art known to applicant at the present time is U.S. Pat. No. 2,381,846 which discloses a removable insole that can be adjusted forwardly or rearwardly and which is provided only with an arcuate elevation not deviating in width or in heighth, said elevation having a flat top. The great toe is off the elevation but there are no other configurations in the removable insole, the rear portion of the insole merely overlying the contour of the outer sole and heel of a shoe.

DETAILED DESCRIPTION

In that embodiment of the invention shown in FIGS. 1 to 6 inclusive, the upper of a shoe has been omitted in FIGS. 1 to 5 for purposes of clarity, there being shown only an insole generally indicated by numeral 1, and an outer sole generally indicated by numeral 2. The insole 1 may be made of any suitable non-rigid material such as a molded synthetic plastic material, polyurethane for example, or a compound of latex and wood or cork chippings or particles such as sawdust, which is molded to conform to the under surface of a human foot, such compound being sufficiently soft to provide at least a slight cushioning effect to the foot and flexible so as to bend with the outer sole when walking. The outer sole 2 may be of any material such as leather, hard artificial leather, or a molded material such as polyurethane or other plastic of a tough wearing quality.

Figure 6:
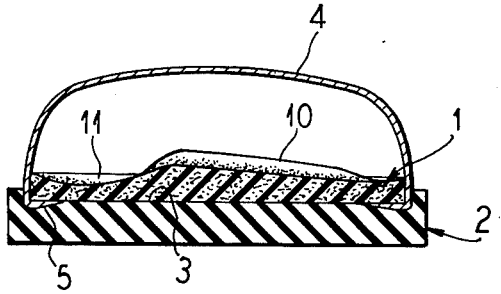
FIG. 6 is a transverse section through a shoe taken substantially as indicated by the section line II—II of FIG. 1 illustrating one manner of attaching the upper to both the insole and outer sole.

The outer sole 2 has a recess 3 in the upper face thereof and as seen in FIG. 6 that recess very snugly accommodates the bottom portion of the insole 1 around which the margin of any conventional shoe upper is turned under and skived as at 5 whereby both the margin and insole may be cemented or otherwise firmly secured to the outsole. This arrangement permits the thickness of the insole and outsole to be reduced to a minimum. The outer sole 2 is also provided with a heel portion 6 which may be of any desired thickness, wedge-shaped or otherwise.

Figure 1:
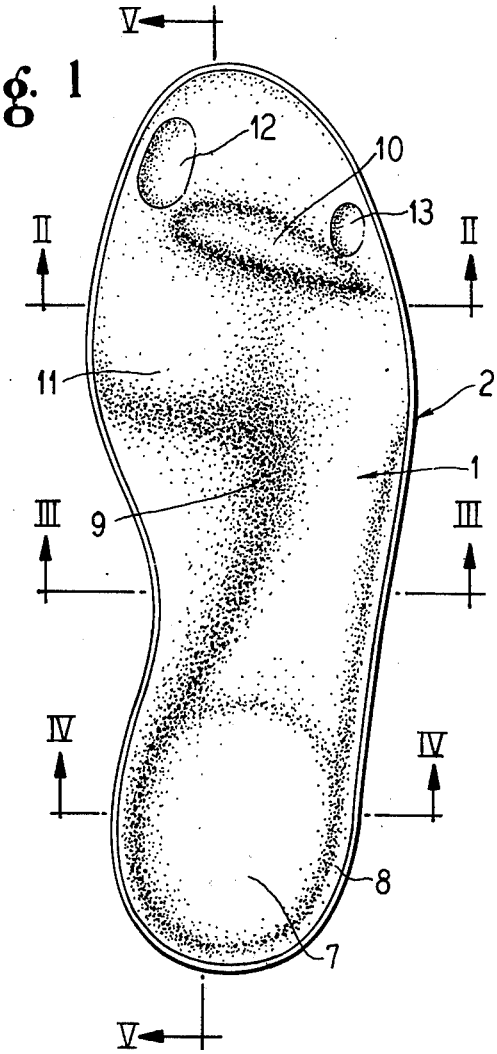
FIG. 1 is a plan view of the insole seen in the recess of the outer sole, the entire shoe upper being removed for clarity.
Figure 2:
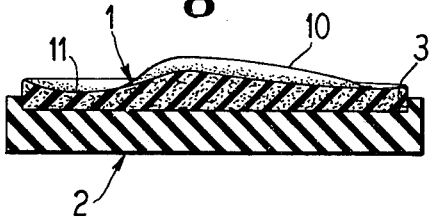
FIG. 2 is an enlarged vertical sectional view taken substantially as indicated by the line II—II of FIG. 1 looking in the direction of the arrows.
Figure 3:
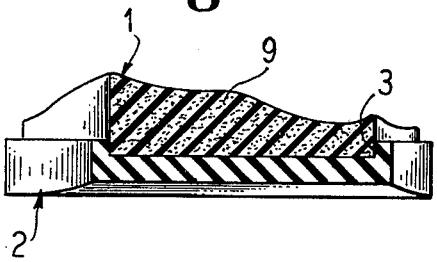
FIG. 3 is an enlarged sectional view taken substantially as indicated by the line III—III of FIG. 1.
Figure 4:
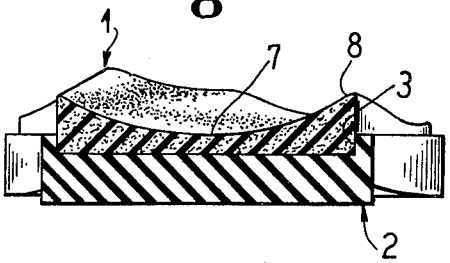
FIG. 4 is an enlarged transverse sectional view taken at the section line IV—IV of FIG. 1.
Figure 5:
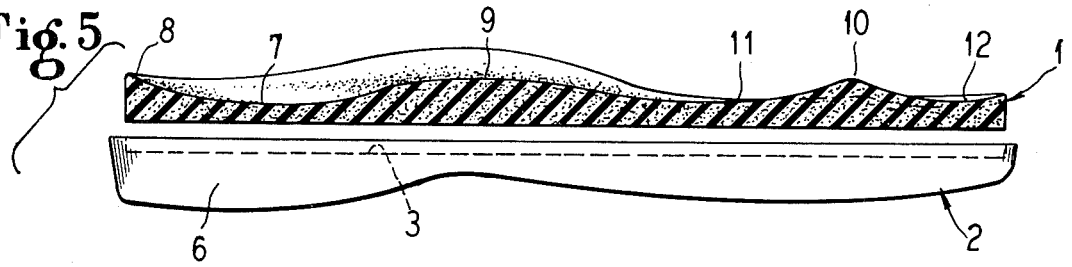
FIG. 5 is an exploded view of the insole and outer sole prior to their being connected.

The insole 1 is shaped to provide an anatomically correct rest for the foot of the user. Shaping includes concave heel seat 7 having a rim 8 therearound which preferably extends to a point adjacent the metatarsal arch of the foot to lend some support to the outside longitudinal arch while the rim on the inner side of the foot merges to an elevation 9 to underlie the inner longitudinal arch of the foot. At the forward portion of the insole, there is an arcuate elevation 10 which varies in width as well as height and underlies the four smaller toes. At the end of the arch supporting elevation 9 or between that and the elevation 10 there is a depression 11 to receive the metatarsal-phalangeal articulation of the great toe and the great toe lies flat off the transverse elevation 10 in a position to balance the foot after the heel strikes in taking a step. The toe lies flatly along side of the elevation, lower than the other toes as seen in FIG. 2 and anteriorly the tip of the great toe or first digital phalanx rests in a slight depression 12. Transverse elevation 10 has a height and width in keeping with the length of the smaller four toes, and the tip of the fifth distal phalanx of the smallest toe rests in a slight depression 13. As clearly shown in FIG. 1, the upper face of the insole 1 between the recesses 12 and 13 is substantially planar, in keeping with the principles of the invention. As stated above, this insole may be made of material absorbent to perspiration, if so desired and there is restful contact throughout the entire surface of the sole of the foot so that standing or walking for a great period of time does not result in aching feet. If the user's foot is normal he will not particularly feel the elevation 9 any more than the other parts of the insole are felt on the plantar surface of the foot. However, should be the user's arch tend to fall, the protection is already there to sustain it in proper position.

Figure 7:
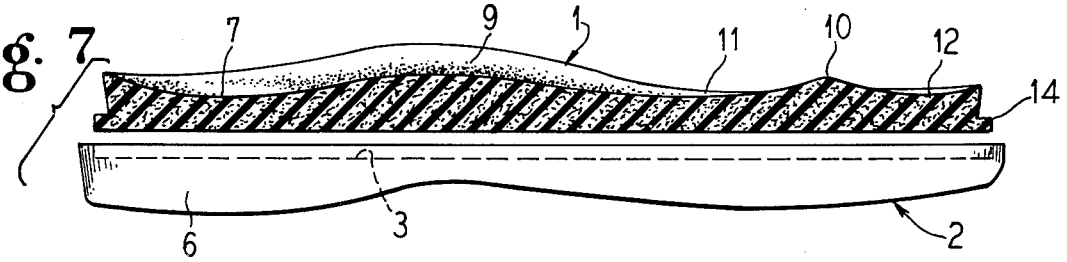
FIG. 7 is another exploded view illustrating a slightly different construction of the insole and prior to the connection of the insole with the outer sole.
Figure 8:
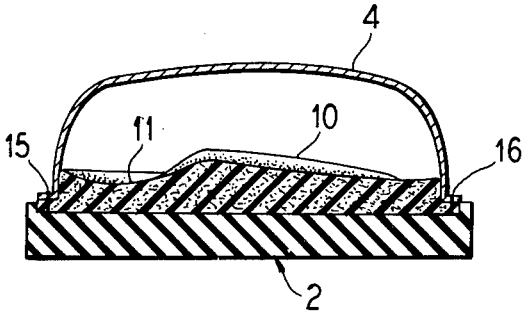
FIG. 8 is a transverse sectional view similar to FIG. 6 but illustrating stitching of the upper in place.

In FIGS. 7 and 8, I have shown a slightly different construction for the insole in that its outer margin is cut so as to provide a circumscribing lip. The exterior edge of this lip 14 snugly fits within the recess 3 of the outer sole 2. The upper 4 may then have an outwardly turned flange 15 overlying the lip 14 of the insole 1 so that the upper may be stitched as indicated at 16 in FIG. 8 to the protruding lip of the insole 1. If so desired, this stitching could, of course, pass entirely through the outer sole as well as the inner sole may be cemented to the upper face of the outer sole or equivalently these parts can be secured together.

It will be understood that the thickness of the outer sole and thickness of the inner sole may be varied at will, the proportion shown in the drawings for the respective parts not being critical.

From the foregoing, it will be apparent that I have provided a comfortable insole that cannot slip in any direction within the article of footwear, and provides such a surface that so fits the plantar surface of the foot that the foot itself cannot slip ontop of the insole but always occupies an anatomically normal position.

I claim:

1. A preformed insole to be built into a shoe or the like during construction of the shoe, the insole having a flat underface for securement to the outer sole of the shoe, wherein the improvement comprises the insole being formed of non-rigid material having an upperface contoured in keeping with the entire plantar face of a normal foot, said insole being flexible to bend with the outer sole of the shoe when walking, the entire shoe with insole secured therein being completed before a customer has seen it, the contour of said upper face of the insole including a cupped heel socket, a support for the inner longitudinal arch of the foot, a mild support for the outer longitudinal arch of the foot, a transverse elevation varying in height and width to underlie the four smaller toes only of the foot, a depression rearward of the inner end of said elevation to receive the articulation of the first metatarsal head with the posterior end of the first proximal phalanx which with the connected distal phalanx lies flatly off said elevation, a respective shallow recess for each of first and fifth distal phalanges, and the upperface of the insole between said recesses being substantially planar.

2. The insole of claim 1, wherein the insole is made of material forming a mild cushioning rest for the entire plantar surface of the foot.

3. The insole of claim 1, wherein the insole is made of absorbent material.

4. The insole of claim 1, wherein said underface of the insole is permanently secured to the upperface of said outer sole.

5. The insole of claim 1, wherein the insole cannot slip relative to the outer sole of the shoe, and the contour of the insole prevent slipping of the foot relatively to the insole.

6. The insole and shoe construction of claim 1, in combination with an outer sole having a preformed recess in its upper face, and the lower part of said insole being seated in said outer sole recess and secured face to face to the outer sole in the bottom of said outer sole recess.

7. The insole and shoe construction of claim 1, in combination with an outer sole having a preformed recess in its upper face, and said insole being sized to snugly fit in said outer sole recess with the margin of the shoe upper turned under the outer margin of the insole, whereby the upper and insole may both be secured to the outer sole in said outer sole recess.

8. The insole and shoe construction of claim 1, in combination with an outer sole having a preformed recess in the top thereof, and said insole having a laterally projecting lip on the lower portion thereof to snugly fit into said outer sole recess, whereby the shoe upper may be flanged outwardly and stitched to said lip or to both said lip and said outer sole.

* * * * *